US008523542B2

(12) United States Patent
Hofstätter

(10) Patent No.: US 8,523,542 B2
(45) Date of Patent: Sep. 3, 2013

(54) PUMPING DEVICE FOR PUMPING FLUID

(75) Inventor: Herbert Hofstätter, Vöcklabruck (AT)

(73) Assignee: Montanuniversitaet Leoben, Leoben (AT)

( * ) Notice: Subject to any disclaimer, the term of this patent is extended or adjusted under 35 U.S.C. 154(b) by 283 days.

(21) Appl. No.: 12/995,933

(22) PCT Filed: Jun. 2, 2008

(86) PCT No.: PCT/EP2008/004373

§ 371 (c)(1),
(2), (4) Date: Feb. 17, 2011

(87) PCT Pub. No.: WO2009/146713

PCT Pub. Date: Dec. 10, 2009

(65) Prior Publication Data

US 2011/0300003 A1 Dec. 8, 2011

(51) Int. Cl.
*F04B 53/12* (2006.01)

(52) U.S. Cl.
USPC ..... 417/553; 417/554; 92/137

(58) Field of Classification Search
USPC ..... 92/134, 137; 417/545, 553, 554
See application file for complete search history.

(56) References Cited

U.S. PATENT DOCUMENTS

| | | | | |
|---|---|---|---|---|
| 3,143,080 A | | 8/1964 | Sutliff | |
| 3,277,836 A | * | 10/1966 | Jooste | 417/553 |
| 4,049,365 A | * | 9/1977 | Sparks, Sr. | 417/554 |
| 5,636,687 A | | 6/1997 | Brown | |

* cited by examiner

*Primary Examiner* — Charles Freay
*Assistant Examiner* — Patrick Hamo
(74) *Attorney, Agent, or Firm* — Robert A. Blaha; Smith Riley Tempel Santos LLC

(57) ABSTRACT

The present invention describes a pumping device (1) for pumping fluids. The pumping device (1) comprises a force transmitting element (2), a tension unit (3) coupled to the force transmitting element (2) and a seal element (10). The force transmitting element (2) is adapted for transferring an upstroke and a downstroke to a pump plunger (5) for pumping fluid (12). The tension unit (3) is adapted for applying a tension force (F) to the force transmitting element (2) for keeping the force transmitting element (2) under tension during the upstroke and the downstroke. The seal element (10) is adapted for sealingly preventing pumping fluids (12) during the downstroke and for enabling pumping fluid (12) during the upstroke. A part (16) of the seal element (10) is rigidly coupled with the force transmitting element (2).

15 Claims, 5 Drawing Sheets

PUMPING DEVICE FOR PUMPING FLUID

FIELD OF THE INVENTION

The invention relates to a pumping device, in particular to a sucker rod pump, and a method for pumping fluid as well as a use of the pumping device.

BACKGROUND OF THE INVENTION

Sucker rod pumps are used throughout the entire industry and are adapted for pumping various kinds of liquids. These pumps are also very popular in oil well production and cover a large percentage of oil wells on artificial lift worldwide. There are three basic types of constructions like insert pumps, tubing pumps and casing pumps.

However, the pump principle is similar for the three different pump types. In such pump devices, in particular in sucker rod pumps, a pump is actuated in a defined depth by the sucker rod string which is hence reciprocated by a beam pumping unit at the surface. The pump is basically composed of a pump plunger that is movably supported in the bore hole and that comprise a travelling valve. At the bottom of the bore hole a pump barrel is installed that includes a standing valve.

During an upstroke of the pump, the plunger is lifted together with the entire column of liquid that is gathered in the bore hole above the plunger. The travelling valve at the lower end of the pump plunger is therefore closed and hinders the liquid column to flow back at the bottom of the bore hole. At the same time the standing valve of the pump barrel is open and allows fluid to fill the pump.

During a downstroke the standing valve of the pump is closed while at the same time the travelling valve opens in order to make all the fluid in the pump flowing through the plunger above into a tubing string.

Thus, the sucker rod string is under tension during the upstroke due to the lifting of the plunger and thus the lifting of the fluid. During the downstroke, the plunger is pushed downwards by the self weight of a sucker rod and therefore the sucker rod is under compression. Due to this compression of the sucker rods, string buckling of the sucker rods may be caused which results in higher friction and wear of the surrounding tubing so that eventually the entire production from the well may be disturbed.

U.S. Pat. No. 4,049,365 discloses an oil well pump with plunger pull-down and descending assembly. One embodiment involves a tension member that extends downwardly below the plunger so that this tension member keeps the plunger under tension without applying compressive force to the pump rod or sucker rod. An embodiment of the pump provides a weight attached to the bottom of the plunger.

OBJECT AND SUMMARY OF THE INVENTION

It is an object of the invention to provide an efficient pumping device.

In order to achieve the object defined above, a pump device and a method for pumping fluids as well as a method of using the device for pumping fluid according to the independent claims are provided.

According to an exemplary embodiment of the invention, a pumping device (such a sucker rod pump) for pumping fluid (such as oil) is provided. The pumping device comprises a force transmitting element, a tension unit coupled to the force transmitting element and a seal element. The force transmitting element is adapted for transferring an upstroke (that is an upward motion) and a downstroke (that is a downward motion) to a pump plunger for pumping fluid. The tension unit is adapted for applying a tension force (which may be directed downwardly) to the force transmitting element for keeping the force transmitting element under tension during the upstroke and during the downstroke. The seal element is adapted for sealingly preventing (that is disabling) pumping fluid during the downstroke and for enabling pumping fluid during the upstroke. A part of the sealing element is rigidly coupled with (or fixedly connected to) the force transmitting element.

According to a further exemplary embodiment, a method for pumping fluid is provided. An upstroke and a downstroke is transferred to a pump plunger for pumping fluid by a force transmitting element. A tension force is applied to the force transmitting element by a tension unit for keeping the force transmitting element under tension during the upstroke and the downstroke. During the downstroke a pumping of fluid is sealingly prevented, and a pumping of fluid is enabled during the upstroke by a seal element. A part of the seal element is rigidly coupled with the force transmitting element.

According to a further exemplary embodiment, a use of an above-described device is provided for drainage purposes, oil production, water catchment or geothermic systems, for instance.

The term "force transmitting element" may describe an element such as a (stiff solid) rod, a (bendable) rope, a belt or a drive belt, that transmits driving force to a pumping device.

The term "seal element" may describe all kinds of known sealing mechanisms, such as ball valves, cylindrical valves, poppet valves, inclined seat valves, pinch valves or plug valves.

The term "part of the sealing element" may describe the movable part of a valve, such as the valve piston etc.

According to an embodiment of the present invention, an incomplex pumping device as well as a pumping device with a reduced amount of parts is provided. The force transmitting element moves during the upstroke and the downstroke the pump plunger so that the fluid is pumped in a predetermined direction. For instance, during an upstroke, the plunger pushes the fluid on the upper side of the pump plunger and simultaneously sucks the fluid on the opposed side in a bore hole. In contrary, in case of a downstroke the plunger is permeable to fluids, for instance by using a travelling valve, so that the plunger can move downwardly in a first position. Thus, on a bottom of the pumping device the seal element is installed, wherein during the upstroke and the sucking below the plunger, fluid may be passed through the seal element. During the downstroke and the movement of the pump plunger to the first position, the sealing element may be closed.

According to the present invention, a part of the seal element is rigidly coupled with the force transmitting element so that a combined system may be provided wherein one and the same movable system provides a sealing ability and an anti-buckling ability. By rigidly adding the part of the seal element to the force transmitting element, the implementation of further sealing elements on the one hand and of further tension units on the other hand may be dispensible. Thus, the system complexity as well as the high amount of parts may be reduced.

Further on, by rigidly coupling the part of the seal element with the force transmitting element, the sealing element is automatically synchronized with the movement, respectively the upstroke and downstroke of the force transmitting element, so that no further installation for synchronizing the sealing element are necessary. Thus, a high sealing performance may be provided.

According to a further exemplary embodiment, the tension unit comprises a tension mass. Thus, by using a tension mass, a dedicated weight force may be applied to the force transmitting element for keeping the force transmitting element under tension during the upstroke and the downstroke. Thus, due to the weight and gravity of the tension mass, a downwardly oriented tension force may be applied in an easy and incomplex way. Further installations may be omitted.

According to a further exemplary embodiment of the present invention, the tension unit comprises a spring unit such as coil spring, a flat spring, or the like. By using a spring unit, the tension unit is independently of a gravity that may be necessary for applying a tension force. Thus, even in inclined boreholes that are not vertically, the spring unit may apply the spring force that may allow providing the tension force to the force transmitting element so that buckling may be provided during a downward motion. During an upward motion, the spring may advantageously contribute to an upwardly oriented force, thereby promoting the upward motion.

According to a further exemplary embodiment, the spring unit is an extension spring, wherein the extension spring is adapted for being biased or pre-stressed during the upstroke and a spring tensile force is applied to the force transmitting element during the downstroke. By the movement of the upstroke the extension spring is elongated and thus a spring tension against the upstroke movement will be applied. This spring tension may act as a tension force. Thus, the spring element may be located in a preferred location wherein a spring tensile force may be used as tension force.

According to a further exemplary embodiment, the spring unit comprises a compression spring. The compression spring is adapted for being compressed during the upstroke and for applying a spring compressive force during the downstroke. Thus, further options for installing the spring unit may be provided so that the pumping system may be more flexible and thus more installation areas of the spring may be available.

According to a further exemplary embodiment, the tension unit comprises a hydraulic unit for applying the tension force to the force transmitting element for keeping the force transmitting element under tension during the upstroke and the downstroke. Additionally or alternatively to the tension mass and/or the spring unit, also hydraulic units for applying the tension force may be provided. Thus, by using a hydraulic unit, the tension force may be changed and adjusted by changing a hydraulic pressure so that a variable tension force may be applied. Further on, as hydraulic medium in the hydraulic unit, the pump fluid itself may be used. As an alternative to the hydraulic unit, also pneumatic units may be applied.

According to a further exemplary embodiment, the pump device further comprises the pump plunger. The tension unit is adapted to transfer a weight force of the fluid to an upper surface of the pump plunger in such a way that by use of the weight force the force transmitting element is kept under tension. Thus, the gravity of a column of fluid that is located above the pump plunger may be used in order to provide a tension force. Thus, the need for further installation elements for applying a tension force may be reduced.

According to a further exemplary embodiment, the force transmitting element comprises a tension rod. The tension rod is adapted for transferring the tension force from the tension unit to the force transmitting element. The tension rod may connect the force transmitting element and the tension unit over a certain distance. Thus, the installation locations of the force transmitting element and the tension unit may differ. Therewith, restrictions due to the design of the pump device may be obsolete.

According to a further exemplary embodiment, the device further comprises a pump barrel with a duct. The duct is adapted for connecting a fluid reservoir with the pump barrel. The part of seal element is adapted for opening the duct during the upstroke and for sealing the duct during the downstroke. The pump barrel is adapted for being filled with a fluid during the upstroke and for being discharged during the downstroke. Thus, by the use of a pump barrel into which for instance the pump plunger may be movably supported, a defined pump volume for the fuel is provided. Further on, the pump barrel provides a separation from the pump device to the fluid reservoir, such as the oil field. The pump barrel comprises the duct through which the pumped fluids may be pumped in the pump barrel during the upstroke. The duct may further be provided with filters for filtering the fluid or may also be variable in its diameter for controlling the amount of fluid and the fluid flow respectively.

According to a further exemplary embodiment of the present invention, the tension unit is located below the pump barrel in a vertical direction. Thus, the tension unit may be located external of the pumping process, so that the tension unit is not exposed to wear or aggressive fluids and corrosion, respectively.

According to a further exemplary embodiment, the seal element is adapted for guiding the force transmitting element. Thus, further stabilization and guidance of the force transmitting element may be provided, if the seal element further acts as bush bearing, for instance. The seal element may therefore comprise a valve seat into which the part of the seal element or the force transmitting element may be movably supported over a certain length. Thus, also horizontal or other directions besides the vertical moving direction may be possible for the force transmitting element, without touching the walls of the pumping device or without to wedge during an upstroke or a downstroke.

According to a further exemplary embodiment, the seal element comprises a cylindrical valve. The cylindrical valve improves the guidance of the force transmitting element or the tension rod. By using the cylindrical valve, it may be possible to guide the force transmitting element or the tension rod through the centre of a valve piston of the cylindrical valve. The valve piston may be the part of the seal element that is rigidly coupled with the force transmitting element to follow any motion of the force transmitting element. The valve piston may be moved according to the upstroke and downstroke and thus being lifted from a valve seat or pressed into the valve seat of the cylindrical valve. The valve seat may be formed in a hole provided in a central portion of a disk or plate which is installed spatially fixed in the pumping device. The force transmitting element may then extend through the hole and may reciprocate to alternatingly open or close the valve, thereby alternatingly enabling or disabling pumping. Thus, the cylindrical valve comprises firstly a mechanical guiding ability of the moving force transmitting element and secondly a sealing ability of the pumping device. Thus, further installations between the cylindrical valve, such as further ducts or further valves in particular ball valves, may be prevented. Thus, by using one cylindrical valve, no further installation elements may be necessary for providing sealing ability and anti-buckling abilities. Further on, in comparison to ball type valves, the cylindrical valve may enable a conduit for the force transmitting element or the tension rod. However, alternative valve geometries are possible as well.

According to a further exemplary embodiment, the pumping device further comprises a control unit such as a microprocessor or a CPU (central processing device). The control unit may be adapted for controlling a flow of the fluid. The control unit may be adapted to control the sealing element in such a way, that a predetermined flow of the fluid, respectively a predetermined flow rate may be provided and adjusted, without being dependent on the downstroke or upstroke movement of the force transmitting element. Thus, stress for the force transmitting element due to a high amount of fluid, respectively due to a high weight of the pumped fluid may be prevented, so that damages of the pump system may be prevented.

According to a further exemplary embodiment, the fluid may be crude oil, gas or water. The term "fluid" may denote any liquid and/or gaseous substance, optionally comprising also solid particles.

According to a further exemplary embodiment, the force transmitting element is selected from one of the group consisting of tension rod strings and pull ropes. Besides the use of tension rod strings (that is solid rods, for instance made of a metallic material), also pull ropes (changing shape upon application of small compression forces) are possible, wherein a pull rope is adapted for pulling the force transmitting element in such a way that a tension force may always be provided to the force transmitting element during the upstroke and the downstroke to prevent bending of the rope.

Because of the above-described tension unit, the entire system is under tension any time and therefore buckling and all the resulting problems coming along with this phenomenon are eliminated. By using in particular the exemplary embodiments there is no restriction in terms of media composition, dimension and borehole trajectory.

The above-described pumping device may be used for drainage purposes, oil protection, water catchment and geothermic systems. Also gas pumping may be possible.

The exemplary embodiments for the pumping device may be also provided to the method and vice versa.

BRIEF DESCRIPTION OF THE DRAWINGS

The invention will be described in more detail hereinafter with reference to examples of embodiment but to which the invention is not limited.

DESCRIPTION OF THE EMBODIMENTS

Figure 1:
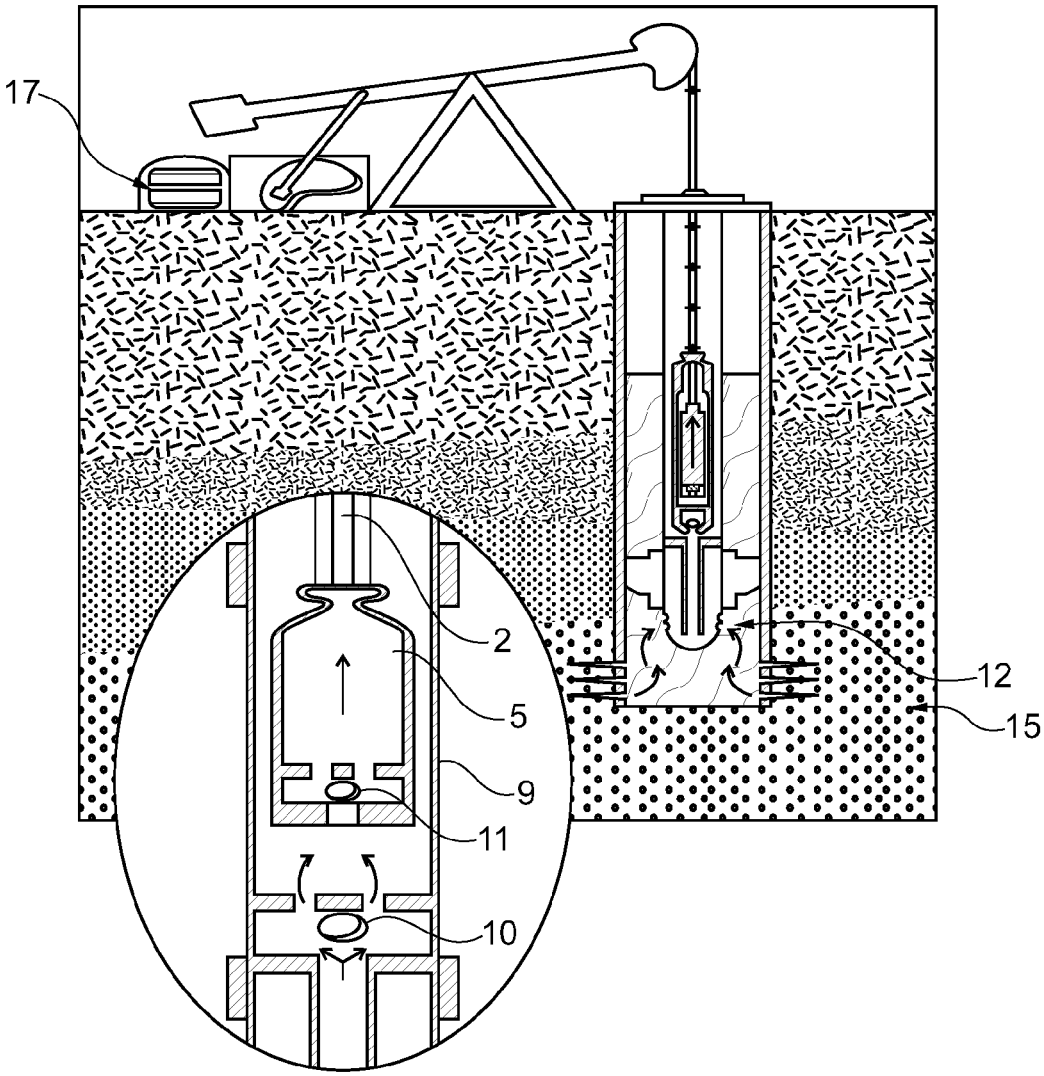
FIG. 1 illustrates a sucker rod pumping system.

The illustrations in the drawings are schematical. In different drawings, similar or identical elements are provided with the same reference signs.

Figure 3:
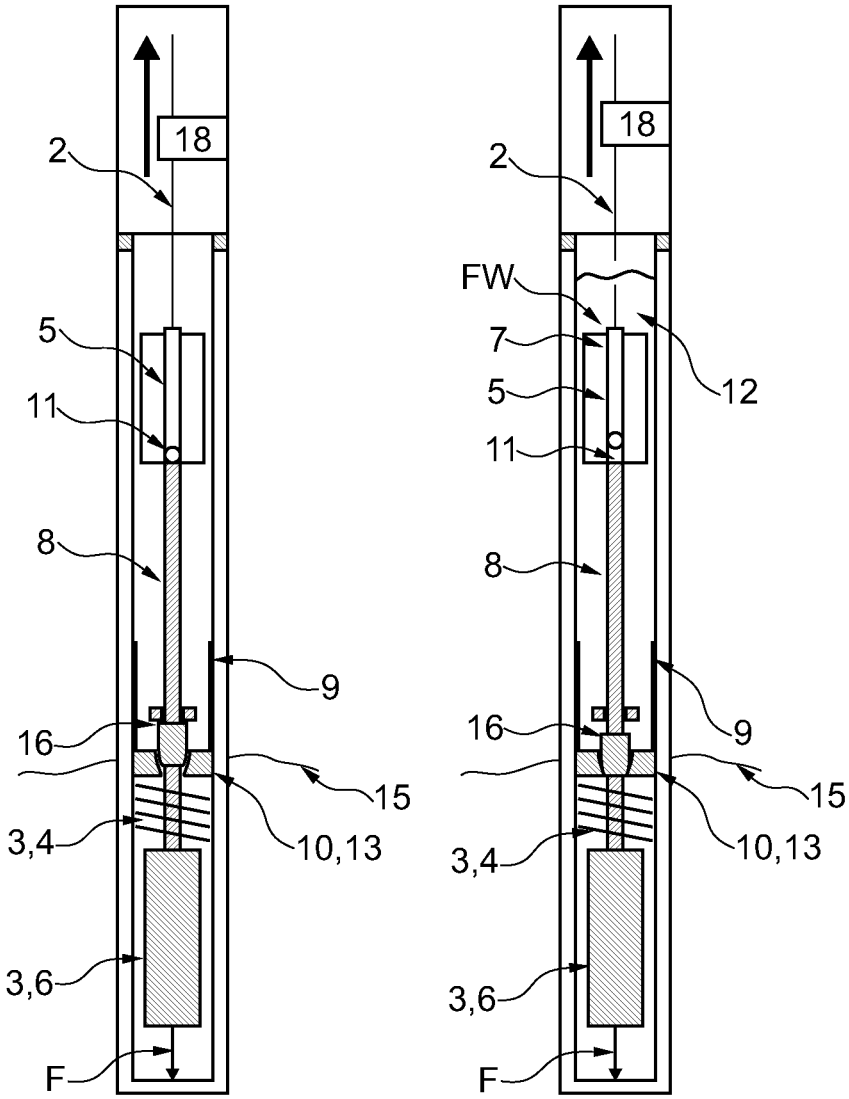
FIG. 3 illustrates a schematical view of an exemplary embodiment of a pumping device according to the present invention.

FIG. 3 illustrates a pumping device 1 according to an exemplary embodiment of the present invention.

The pumping device 1 is shown in an upstroke status (left-hand side) and a downstroke status (right-hand side).

The pumping device 1 comprises a force transmitting element 2, a tension unit 3 coupled to the force transmitting element 2 and a seal element 10. The force transmitting element 2 is adapted for transferring an upstroke force and a downstroke force to a pump plunger 5 for pumping fluid 12, namely crude oil. A tension unit 3 is adapted for applying or superpositioning a tension force F to the force transmitting element 2 for keeping the force transmitting element 2 under tension during both the upstroke and the downstroke. The seal element 10 is adapted for sealing for preventing pumping fluid 12 during the downstroke, and for enabling pumping fluid during the upstroke. A part 16 of the seal element 10 is rigidly coupled with the force transmitting element 2.

A pumping principle of a sucker rod pump 1 is illustrated in FIG. 1. A prime mover 17 drives the pump plunger 5 and transmits the driving force by the force transmitting element 2. In FIG. 1, the force transmitting element 2 is a sucker rod. The pump plunger 5 is movably supported in the pump barrel 9. Further on, the pump plunger 5 comprises a travelling valve 11 that is able to pass fluid 12 during a down movement respectively the downstroke of the pump plunger 5 and is closed during an upward movement respectively an upstroke of the pump plunger 5. Thus, fluid 12 may be pumped.

Figure 2:
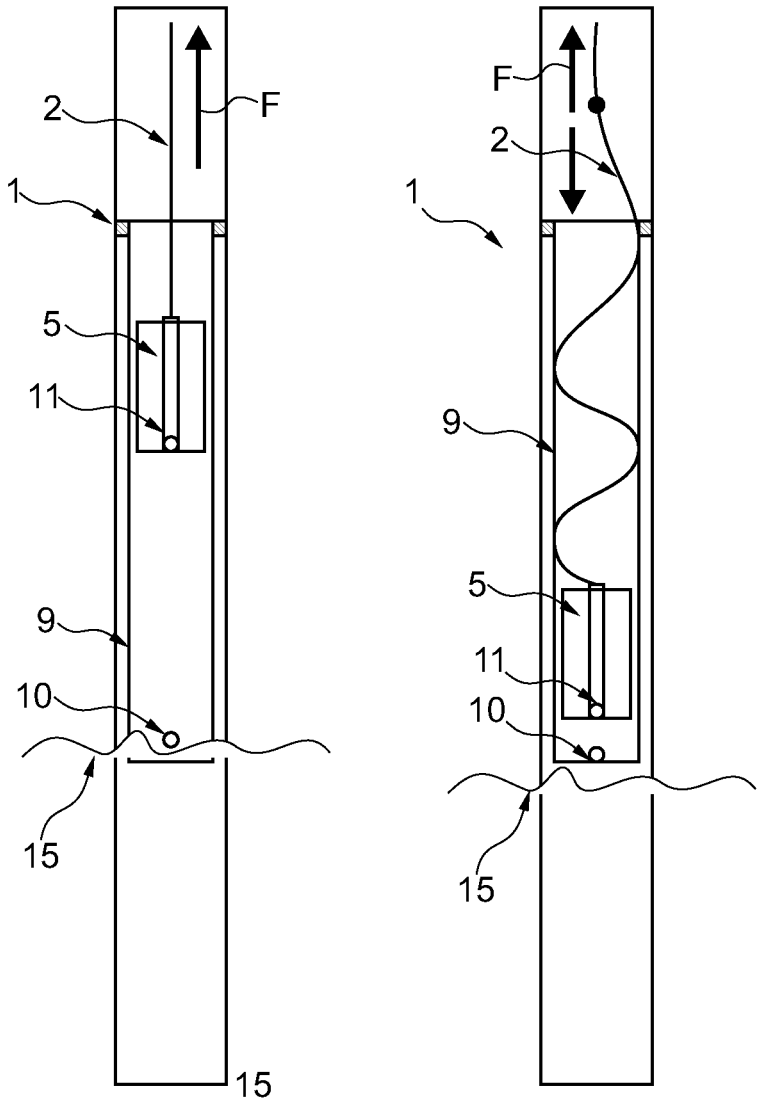
FIG. 2 illustrates a schematical view of a conventional pumping system of a sucker rod pump.

FIG. 2 illustrates a schematical view of a conventional sucker rod pump 1 during an upstroke (left-hand side) and a downstroke (right-hand side) of the pump plunger 5. During the upstroke, shown on the left side of FIG. 2, the pump plunger 5 is moved upwardly such that the pump plunger 5 pumps fluid 12 on the upper surface 7 of the pump plunger 5 and sucks during the upward movement fluid 12 into the pump barrel 9. Thus, the seal element 10 is open and the travelling valve 11 is closed.

During the downstroke, shown on the right side of FIG. 2, the travelling valve 11 is opened and the seal element 10 is closed. Thus, during a downstroke or a downward movement of the pump plunger 5 in the pump barrel 9 the fluid 12 passes the pump plunger 5 through the opened travelling valve 11 so that the fluid 12 is located above the upper surface 7 of the pump plunger 5. Then, again during the upstroke, the fluid 12 is pumped upwardly, because the travelling valve 11 is closed again and further fluid 12 is sucked into the pump barrel 9.

As illustrated in FIG. 2, during the downstroke a compressive force acts on the force transmitting element 2. Therefore, compression buckling may occur such that the force transmitting element 2 may burst or may contact the sidewalls during the downstroke movement. In the latter scenario, wear of all movable parts may occur such that these parts have to be exchanged only after a short pumping period.

FIG. 3 illustrates an exemplary embodiment of a pumping device 1 according to the present invention.

As illustrated in FIG. 3, a tension unit 3 may apply a tension force F to the force transmitting element 2 for keeping the force transmitting element 2 under tension during the upstroke, shown on the left side of FIG. 3, and the downstroke, shown on the right side of FIG. 3.

In one exemplary embodiment, the tension force F may be applied by a tension mass 6 of the tension unit 3. Therewith, the weight 6 has to be connected to the pump plunger 5 or the force transmitting element 2, for instance by a tension rod 8. In order to provide an open status of the seal element 10 during the upstroke, a part 16 of the seal element 10 is rigidly coupled with the force transmitting element 2 or the tension rod 8. The part 16 of a seal element 10 may comprise or consist of a valve piston, for instance.

Thus, by the rigid connection of the part 16 of the seal element 10 to the force transmitting element 2 or the tension rod 8, the opening state and the closed state of the seal element 10 is automatically synchronized with the upstroke phase and the downstroke phase of the pump device 1. No further regulation elements may be necessary, and the provision of an anti-buckling feature is simplified.

Additionally or alternatively to the provision of the tension mass 6, the tension force F may be applied to the force transmitting element 2 by a spring unit 4. If the spring unit 4 is located for being pre-tensioned during the upstroke, an extension spring may be installed. Thus, during the downstroke, the extension spring applies a tension force F during the downstroke.

If the spring unit 4 is located at a location where the spring is elongated during the upstroke a compression spring may be installed such that during the downstroke a compressive force provides the tension force F.

Referring to FIG. 3, also a hydraulic unit 18 may be installed in order to provide a tension force F to the force transmitting element 2. The hydraulic unit 18 may comprise a hydraulic cylinder that is telescopically extendable in the direction of the upstroke or the downstroke. Therewith, by controlling the hydraulic pressure, a desirable tension force F may be applied. Beneath the hydraulic cylinder 18, also pneumatical installations may be applied in order to act as hydraulic unit 18.

Further on, it is possible to provide the tension unit 3 for using the pumped fluid 12 on the upper surface 7 of the pump plunger 5 for applying a tension force F to the force transmitting element 2. By keeping the pump fluid 12 on the upper surface 7 of the pump plunger 5 during the downstroke, the weight force FW generated due to the mass of the fluid 12 applies a tension force F to the force transmitting element 2. Thus, no further complex installations may be needed.

Figure 4A:
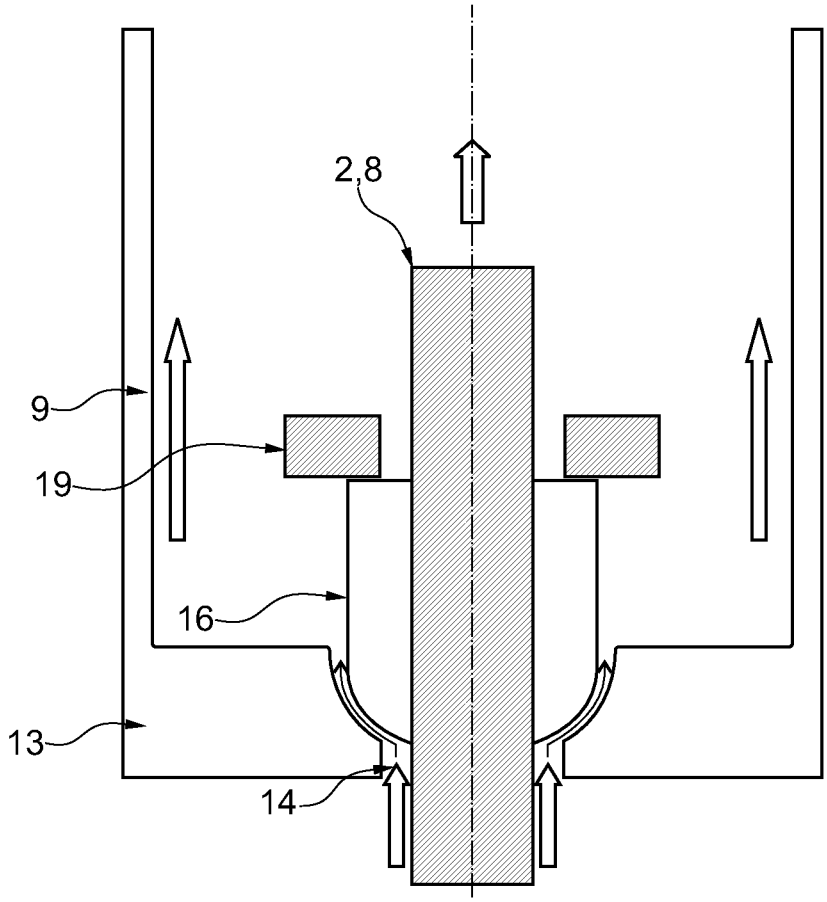
FIG. 4*a*, 4*b* illustrate a schematical view of a seal element according to an exemplary embodiment of the present invention.
Figure 4B:
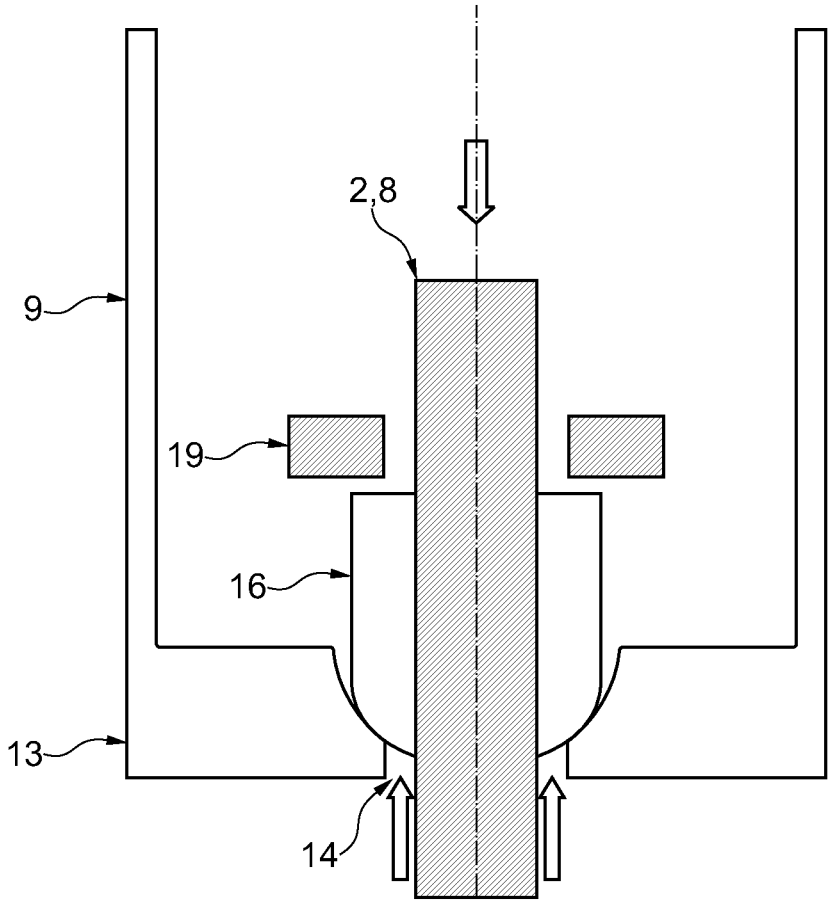

FIG. 3, as well as FIG. 4*a* and FIG. 4*b*, shows also a possibility to guide the force transmitting element 2, respectively the tension rod 8 of the force transmitting element 2 through the part 16 of the seal element 10. The part 16 of the seal element 10 may act as a seal piston and may close the seal element 10 by a connection to a valve seat 13. Thus, the movement of the force transmitting element 2 and the part 16 of the seal element 10 open and close a duct 14 of the seal element 10 in order to control a fluid flow of the pump device 1. The tension unit 3 may be located below the seal element 10 respectively the pump barrel 9 in vertical direction. Thus, the seal element 10 respectively the part 16 of the seal element 10 may guide the force transmitting element 2 or the tension rod 8. Thus, also in inclined boreholes the pump device 1 according to the present invention is applicable. In inclined boreholes, because of the guiding ability of the duct 14 in the seal element 10, the force transmitting element 2 is not in contact with the sidewalls due to gravity.

For a better guiding ability the seal elements 10 may consist of a cylindrical valve, as illustrated in more detail in FIG. 4*a*, 4*b*. Thus, the part 16 of the seal element 10 may consist of a valve piston and thus comprise an elongated cylindrical surface that can be in slidable contact with the force transmitting element 2. Further on, in comparison to ball type valves, the cylindrical valve may enable a conduit for the force transmitting element 2 or the tension rod 8.

Further on, a control unit (not shown) may be installed that opens the seal element 10 in a variable manner. The control unit may flexibly control the opening of the seal element 10 during the upstroke so that a desirable fluid flow during the upstroke into the pump barrel 9 may be adjusted.

With the pump device 1 of the present invention a variety of fluids 12 may be pumped such as crude oil, water, thermal water or gas.

FIGS. 4*a* and 4*b* illustrate a detailed view of the seal element 10 during an upstroke and a downstroke. The force transmitting element 2 or the tension rod 8 are rigidly connected to the part 16 of the seal element 10. The part 16 is adapted for being form closed with the sidewalls of the duct 14 in the valve seat respectively the seal element 10. During the upstroke, the part 16 is lifted from the valve seat 13. The lift of the upstroke may be terminated by a seal cage 19. Due to the form closed contact of the part 16 and the valve seat 13, a good guiding ability of the force transmitting element 2 may be provided.

Finally, it should be noted that the above-mentioned embodiments illustrate rather than limit the invention, and that those skilled in the art will be capable of designing many alternative embodiments without departing from the scope of the invention as defined by the appended claims. In the claims, any reference signs placed in parentheses shall not be construed as limiting the claims. The words "comprising" and "comprises", and the like, do not exclude the presence of elements or steps other than those listed in any claim or the specification as a whole. The singular reference of an element does not exclude the plural reference of such elements and vice-versa. In a device claim enumerating several means, several of these means may be embodied by one and the same item of software or hardware. The mere fact that certain measures are recited in mutually different dependent claims does not indicate that a combination of these measures cannot be used to advantage.

LIST OF REFERENCE SIGNS

1 pump device
2 force transmitting element
3 tension unit
4 spring unit
5 pump plunger
6 tension mass
7 upper surface of the pump plunger
8 tension rod
9 pump barrel
10 seal element
11 traveling valve
12 fluid
13 valve seat
14 duct
15 fluid reservoir
16 part of the seal element
17 prime mover
18 hydraulic unit
19 seal cage
F tension force
FW weight force of the fluid

The invention claimed is:

1. A pumping device for pumping fluid, wherein the pumping device comprises:

a force transmitting element;

a tension unit coupled to the force transmitting element; and a seal element;

wherein the force transmitting element is adapted for transferring an upstroke and a downstroke to a pump plunger for pumping fluid;

wherein the tension unit is adapted for applying a tension force to the force transmitting element for keeping the force transmitting element under tension during the upstroke and the downstroke;

wherein the seal element is adapted for sealingly preventing pumping fluid during the downstroke and for enabling pumping fluid during the upstroke; and wherein a moveable part of the seal element is rigidly coupled or is in slidable contact with the force transmitting element, so that the seal element is synchronized with a movement of the force transmitting element.

2. The pumping device of claim 1, wherein the tension unit comprises a tension mass.

3. The pumping device of claim 1,
wherein the tension unit comprises a spring unit.

4. The pumping device of claim 3,
wherein the spring unit comprises an extension spring;
wherein the extension spring is adapted for being biased during the upstroke and for applying a tensile force to the force transmitting unit during the downstroke.

5. The pumping device of claim 3,
wherein the spring unit comprises a compression spring;
wherein the compression spring is adapted for being compressed during the upstroke and for applying a compressive force to the force transmitting unit during the downstroke.

6. The pumping device of claim 1,
wherein the tension unit comprises a hydraulic unit for applying the tension force to the force transmitting element for keeping the force transmitting element under tension during the upstroke and the downstroke.

7. The pumping device of claim 1, further comprising:
the pump plunger;
wherein the tension unit is adapted to transfer a weight force of the fluid to an upper surface of the pump plunger in such a way that by use of the weight force the force transmitting element is kept under tension.

8. The pumping device of claim 1,
wherein the force transmitting element comprises a tension rod,
wherein the tension rod is adapted for transferring the tension force from the tension unit to the force transmitting element.

9. The pumping device of claim 8, further comprising:
a pump barrel with a duct;
wherein the duct is adapted for connecting a fluid reservoir with the pump barrel;
wherein the part of the seal element is adapted for opening the duct during the upstroke and for sealingly closing the duct during the downstroke;
wherein the pump barrel is adapted for being filled with the fluid during the upstroke and for being discharged during the downstroke.

10. The pumping device of claim 9,
wherein the tension unit is located below the pump barrel in a vertical direction.

11. The pumping device of claim 1,
wherein the seal element is adapted for guiding the force transmitting element.

12. The pumping device of claim 1,
wherein the seal element comprises a cylindrical valve.

13. The pumping device of claim 1,
wherein the fluid is selected from one of the group consisting of crude oil, gas and water.

14. The pumping device of claim 1,
wherein the force transmitting element is selected from one of the group consisting of a tension rod string and a pull ropes.

15. A method for pumping fluid, wherein the method comprises:
transferring an upstroke and a downstroke by a force transmitting element to a pump plunger for pumping fluid;
applying a tension force to the force transmitting element by a tension unit for keeping the force transmitting element under tension during the upstroke and the downstroke;
sealingly preventing pumping fluid during the downstroke and enabling pumping fluid during the upstroke by a seal element; and
coupling a movable part of the seal element rigidly with or in slidable contact to the force transmitting element, so that the seal element is synchronized with a movement of the force transmitting element.

* * * * *